US008682008B2

(12) United States Patent
Tracy

(10) Patent No.: US 8,682,008 B2
(45) **Date of Patent: *Mar. 25, 2014**

(54) SPEAKER ASSEMBLY

(76) Inventor: Dennis A. Tracy, Culver City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/571,934

(22) Filed: Aug. 10, 2012

(65) Prior Publication Data

US 2012/0314888 A1 Dec. 13, 2012

Related U.S. Application Data

(63) Continuation of application No. 12/572,814, filed on Oct. 2, 2009, now Pat. No. 8,249,282.

(60) Provisional application No. 61/113,376, filed on Nov. 11, 2008.

(51) Int. Cl.
*H04R 1/02* (2006.01)
*H04R 1/26* (2006.01)

(52) U.S. Cl.
CPC *H04R 1/026* (2013.01); *H04R 1/26* (2013.01); *H04R 2205/022* (2013.01)
USPC ..... 381/184; 381/182; 381/386

(58) Field of Classification Search
USPC ..... 381/182, 184, 345, 374, 386, 387, 395; 181/148, 163, 171, 189, 198, 199
See application file for complete search history.

(56) References Cited

U.S. PATENT DOCUMENTS

| | | | | |
|---|---|---|---|---|
| 3,065,816 | A | 11/1962 | Ranger | |
| 4,597,470 | A | 7/1986 | Takagi et al. | |
| 5,258,584 | A | 11/1993 | Hubbard | |
| 5,512,714 | A | 4/1996 | Fenton | |
| 5,874,695 | A | 2/1999 | Tracy | |
| 6,118,883 | A | 9/2000 | Rocha | |
| 6,279,678 | B1 | 8/2001 | Tracy | |
| 6,719,090 | B2 | 4/2004 | Tracy | |
| 2003/0164263 | A1 * | 9/2003 | Tracy | 181/199 |

* cited by examiner

*Primary Examiner* — Tuan D Nguyen
(74) *Attorney, Agent, or Firm* — Welsh Flaxman & Gitler LLC

(57) ABSTRACT

A speaker assembly includes a speaker housing with a closed top wall that is substantially planar and forms a support surface. A first midrange driver and a first tweeter are mirror images of a second midrange driver and a second tweeter. A first support bracket supports the first midrange driver and first tweeter along a first side of the closed top wall adjacent the first sidewall of the speaker housing. The first support bracket includes a planar support surface which is obliquely oriented relative to a plane in which the closed top wall lies. A second support bracket supports the second midrange driver and the second tweeter along a second side of the closed top wall adjacent the third sidewall of the speaker housing. The second support bracket includes a planar support surface which is obliquely oriented relative to the plane in which the closed top wall lies.

15 Claims, 8 Drawing Sheets

SPEAKER ASSEMBLY

CROSS REFERENCE TO RELATED APPLICATION

This application is a continuation of U.S. patent application Ser. No. 12/572,814, filed Oct. 2, 2009 now U.S. Pat. No. 8,249,282, entitled "SPEAKER ASSEMBLY", which claims the benefit of U.S. Provisional Application No. 61/113,376, filed Nov. 11, 2008.

BACKGROUND OF THE INVENTION

1. Field of the Invention

The invention relates to a speaker assembly. More particularly, the invention relates to a speaker assembly with reduced size and weight to enhance the performance of the speaker assembly within an aircraft.

2. Description of the Related Art

The current global community has made it possible for people all around the country, and around the world, to interact for both business and personal reasons. For many people, this requires they spend considerable time traveling from one location to another location. More often than not, these people travel in aircraft. Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft make it very difficult to incorporate high fidelity systems within an aircraft. This problem is especially pronounced for audio loudspeaker assemblies when one attempts to meet the size, weight and shape requirements for use in aircrafts.

In the aircraft industry, great priority is placed upon component weight and size reduction. In addition, spacing and positioning of the loudspeaker assemblies are a great priority to those optimizing the operation of aircraft. The size, weight and shape of conventional terrestrial loudspeaker assembly designs adversely affect range and payload. These concerns are notable when one attempts to make changes within smaller, private jets. For example, a small increase in the weight carried by an aircraft results in a substantial increase in fuel consumption of the aircraft. In addition, the limited space available within an aircraft dictates the use of any space within the aircraft be carefully considered by those responsible for ensuring the comfort of passengers.

Lightweight and compact audio loudspeakers are currently available. These loudspeakers, however, substantially compromise sound quality for reductions in size and weight. An individual wishing to add an audio system to an aircraft must make a choice between high fidelity loudspeakers not suiting the size and weight requirements of the aircraft and lower quality loudspeakers providing desirable size and weight characteristics.

A need, therefore, exists for a loudspeaker assembly providing high fidelity sound, while meeting the size and weight requirements of an aircraft. The present invention provides such a loudspeaker assembly.

SUMMARY OF THE INVENTION

It is, therefore, an object of the present invention to provide a speaker assembly including a speaker housing with a closed top wall, an opposed open end and first, second, third and fourth sidewalls extending downwardly from the closed top wall. The closed top wall is substantially planar and forms a support surface. First and second midrange drivers and first and second high frequency drivers are mounted within the housing, wherein the first midrange driver and the first tweeter are mirror images of second midrange driver and the second tweeter. A first support bracket supports the first midrange driver and first tweeter along a first side of the closed top wall adjacent the first sidewall of the speaker housing. The first support bracket includes a planar support surface which is obliquely oriented relative to a plane in which the closed top wall lies. A second support bracket supports the second midrange driver and the second tweeter along a second side of the closed top wall adjacent the third sidewall of the speaker housing. The first support bracket includes a planar support surface which is obliquely oriented relative to the plane in which the closed top wall lies.

It is also an object of the present invention to provide a speaker assembly wherein spacers are positioned between the public address driver support bracket, the first support bracket, and the second support bracket.

It is another object of the present invention to provide a speaker assembly wherein the first and second midrange drivers are constructed with carbon fiber cones and neodymium magnets.

It is a further object of the present invention to provide a speaker assembly wherein the first and second tweeters are constructed with neodymium magnets and polypropylene cones.

It is also an object of the present invention to provide a speaker assembly including a public address driver and a public address driver support bracket supporting the public address driver.

It is another object of the present invention to provide a speaker assembly wherein the public address driver support bracket includes a planar support surface from which first and second support legs extend. The first and second support legs engage, and are secured to, an interior surface of the second sidewall and the fourth sidewall of the speaker housing for supporting the planar support surface in a spaced relationship with regard to the closed top wall such that the planar support surface lies in a plane which is substantially parallel to the plane in which the closed top wall lies.

It is a further object of the present invention to provide a speaker assembly wherein the planar support surface is also substantially aligned with upper edges of the respective first, second, third and fourth sidewalls.

It is also an object of the present invention to provide a speaker assembly wherein the first support bracket is composed of the planar support surface from which first and second support legs extend. The first leg engages, and is secured to, the second sidewall adjacent the upper edge of the second sidewall and the second leg engages, and is secured to the fourth sidewall adjacent the juncture of the fourth sidewall and the closed top wall.

It is another object of the present invention to provide a speaker assembly wherein the planar support surface of the first support bracket is oriented to lie in a plane that is oriented at approximately an 18.5 degree angle with respect to a plane in which the closed top wall lies.

It is a further object of the present invention to provide a speaker assembly wherein the second support bracket is composed of the planar support surface from which first and second support legs extend. The first leg engages, and is secured to, the fourth sidewall adjacent the upper edge of the fourth sidewall and the second leg engages, and is secured to the second sidewall adjacent the juncture of the second sidewall and closed top wall.

It is also an object of the present invention to provide a speaker assembly wherein the planar support surface of the second support bracket is oriented to lie in a plane that is oriented at approximately an 18.5 degree angle with respect to a plane in which the closed top wall lies.

It is another object of the present invention to provide a speaker assembly wherein the closed top wall includes a first inwardly directed flange and a second inwardly directed flange formed along the surface thereof in the driver. The closed top wall also includes a first guide member adjacent the first inwardly directed flange and a second guide member adjacent the second inwardly directed flange.

It is a further object of the present invention to provide a speaker assembly wherein each of the first guide member and the second guide member are semi-circular annular members extending upwardly from the closed top wall at positions adjacent edges of the closed top wall.

It is also an object of the present invention to provide a speaker assembly wherein each of the first inwardly directed flange and the second inwardly directed flange includes a first end and a second end, as well as a first lateral side edge and second lateral side edge. The first end is secured to the closed top wall while the second end freely extends upwardly and into a space defined by the speaker housing.

It is another object of the present invention to provide a speaker assembly wherein an aperture is formed adjacent the second end of the respective first inwardly directed flange and the second inwardly directed flange.

It is a further object of the present invention to provide a speaker assembly including a speaker housing with a closed top wall, an opposed open end and first, second, third and fourth sidewalls extending downwardly from the closed top wall. The closed top wall is substantially planar and forms a support surface. A driver support bracket supports a driver. The closed top wall includes a first inwardly directed flange and a second inwardly directed flange formed along the surface thereof in the driver. The closed top wall also includes a first guide members adjacent the first inwardly directed flange and a second guide member adjacent the second inwardly directed flange.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
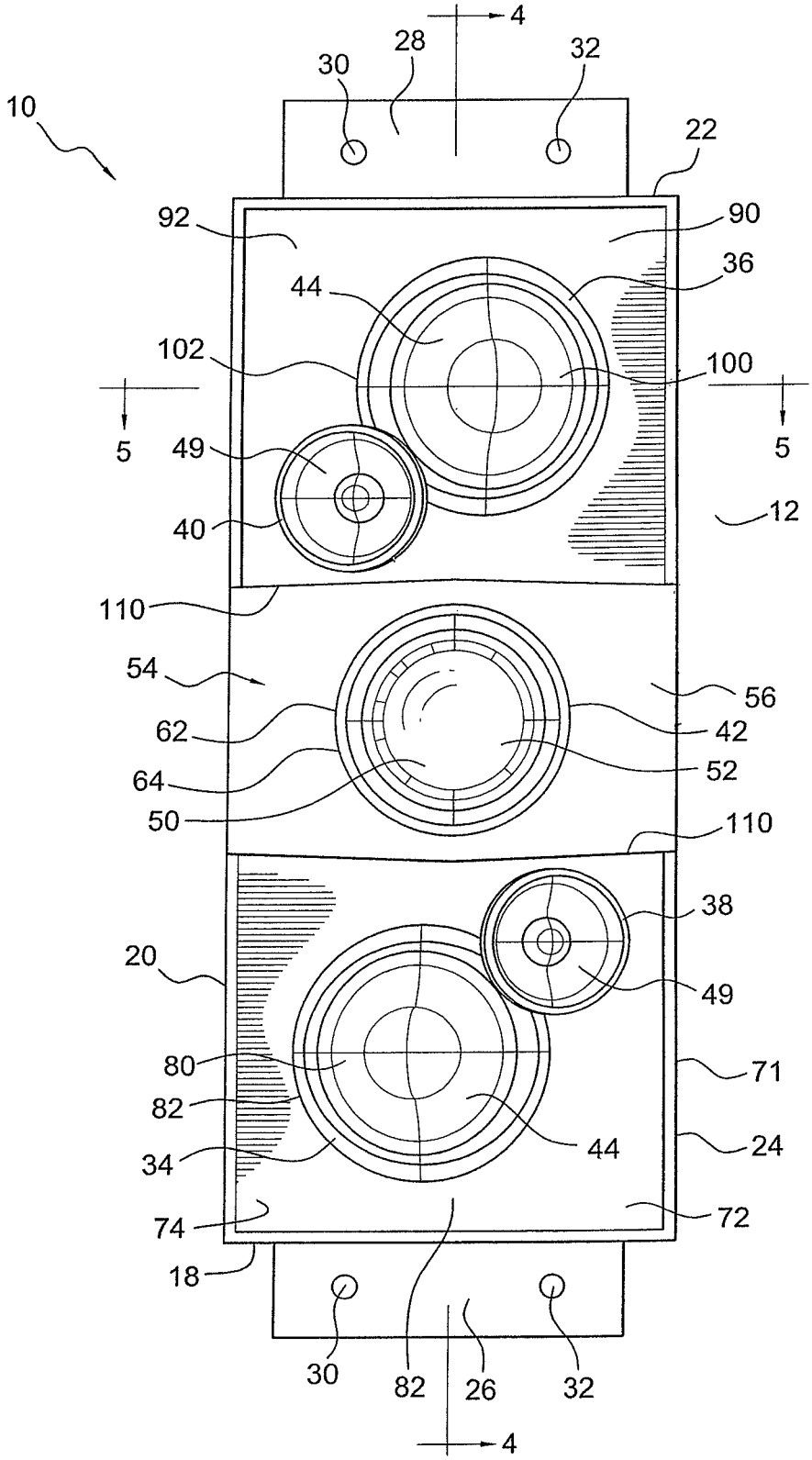
FIG. 1 is a top view of the speaker assembly in accordance with the present invention.
Figure 2:
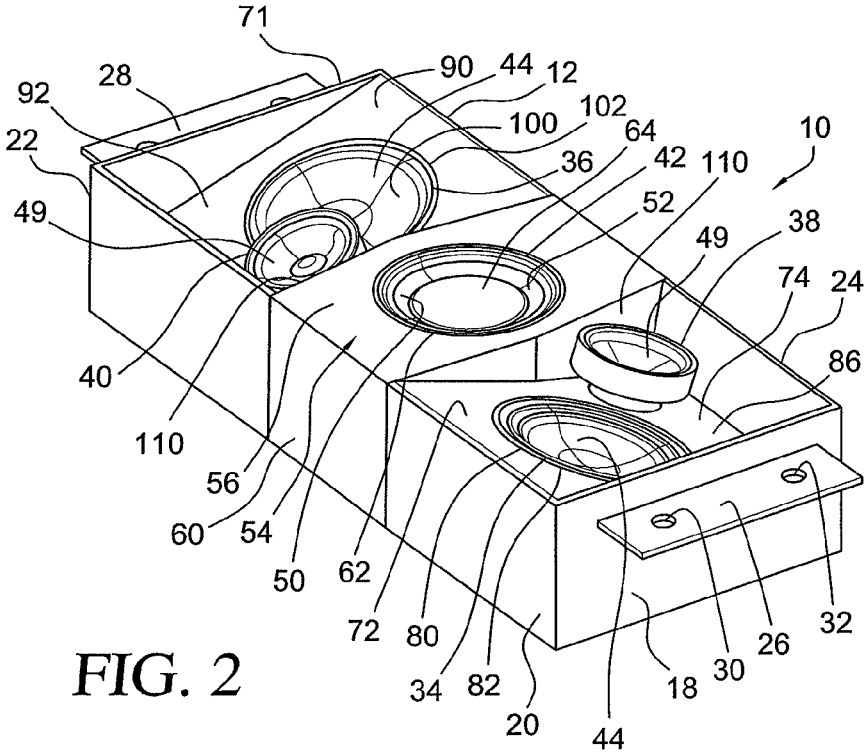
FIGS. 2 and 3 are respective perspective view of the speaker assembly shown with reference to FIG. 1.
Figure 3:
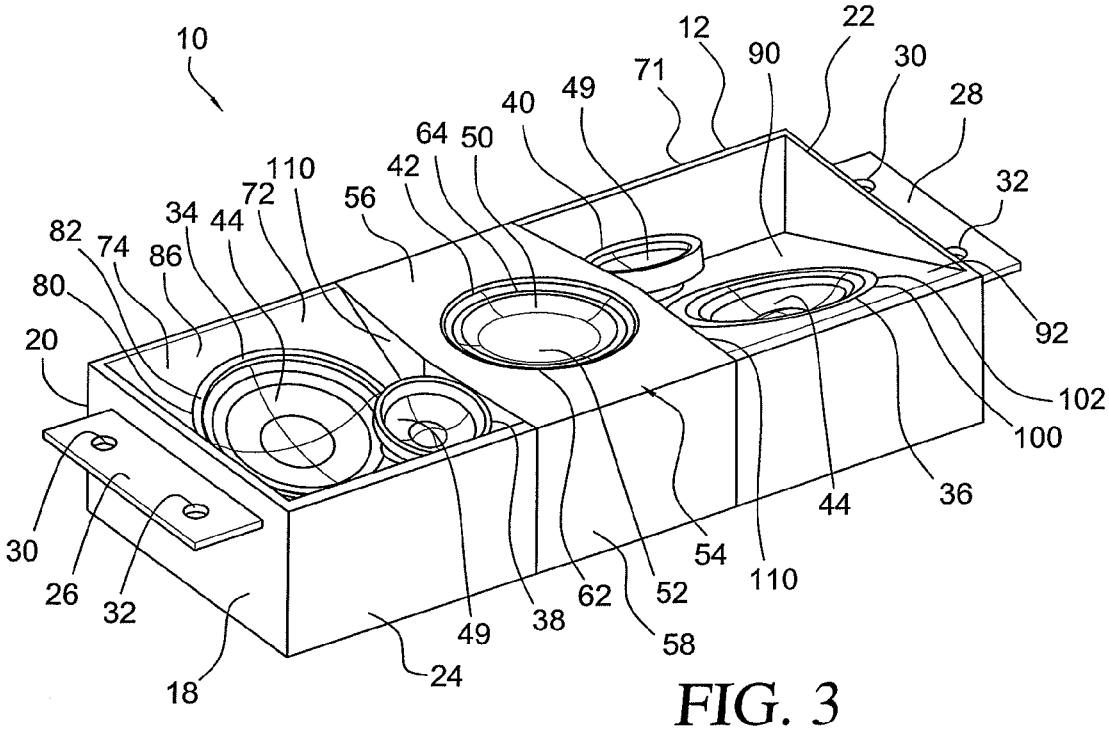
Figure 4:
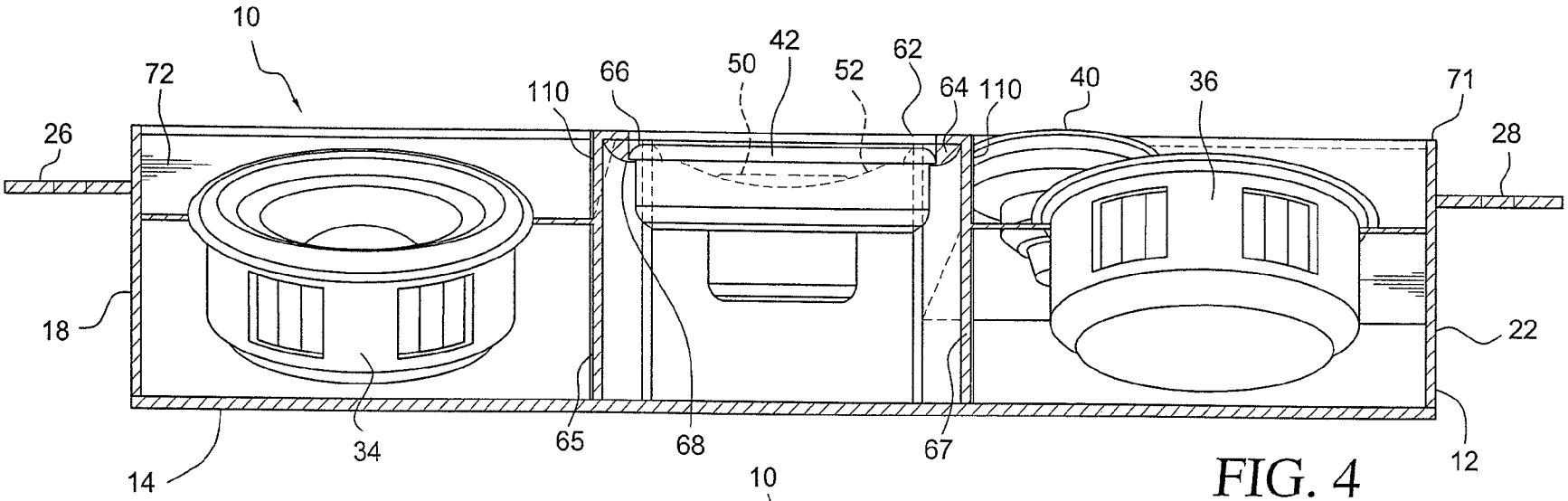
FIG. 4 is a partial cross sectional view along the line 4-4 in FIG. 1
Figure 5:
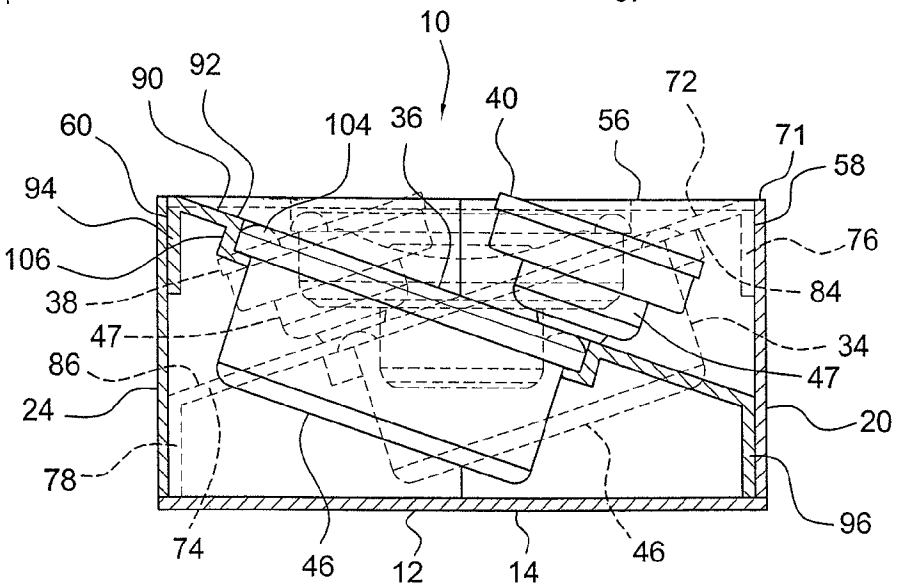
FIG. 5 is a cross sectional view along the line 5-5 in FIG. 1.
Figure 6:
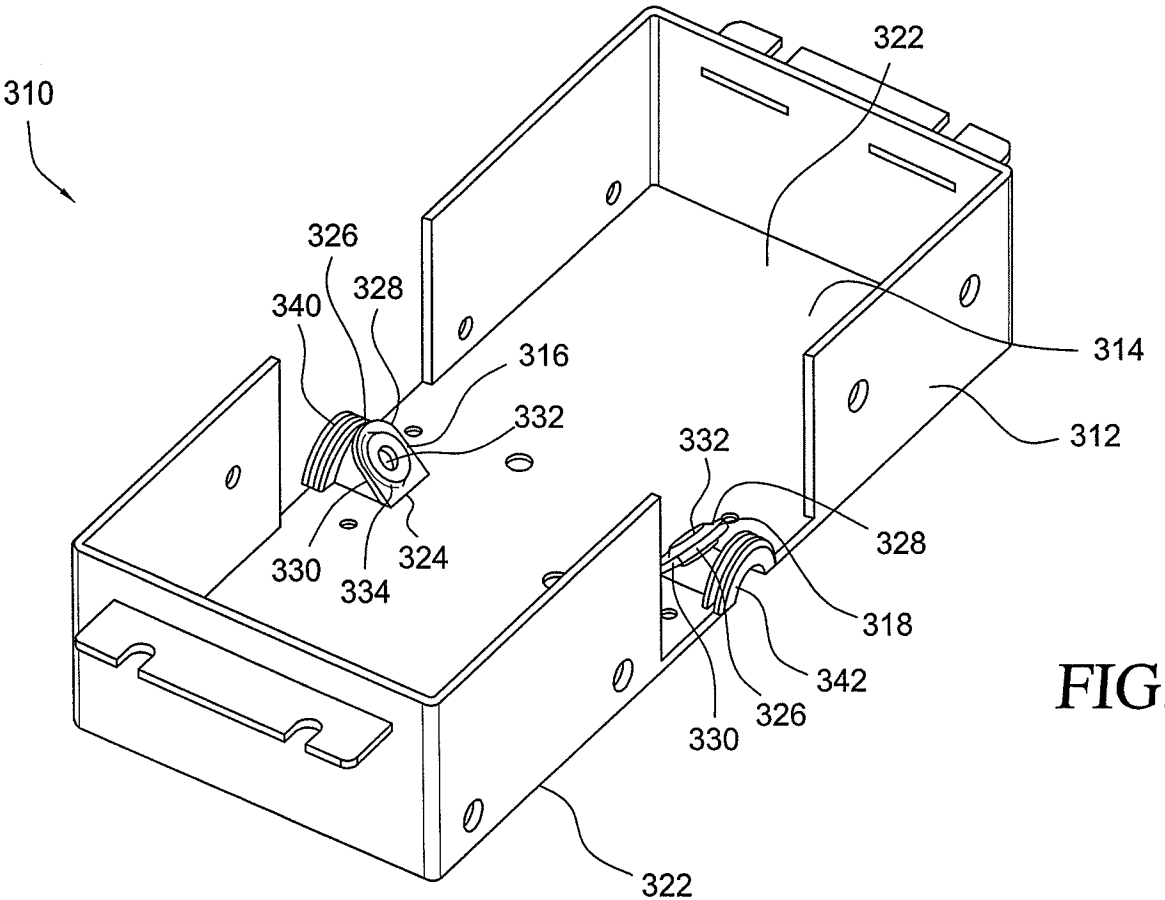
FIG. 6 is a perspective view of the speaker housing in accordance with an alternate embodiment.
Figure 7:
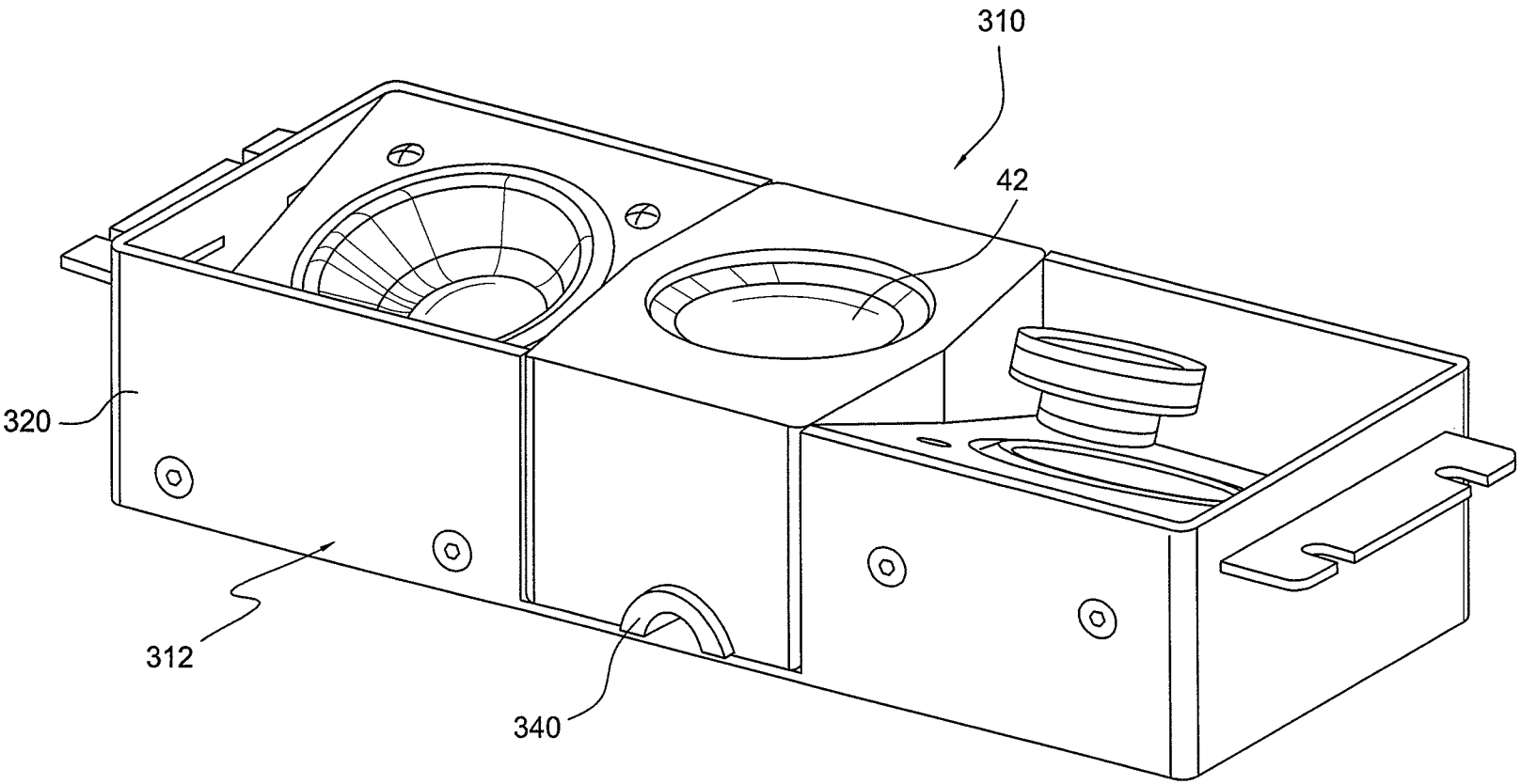
FIG. 7 is a perspective view of a speaker assembly in accordance with the embodiment disclosed with reference to FIG. 6.
Figure 8:
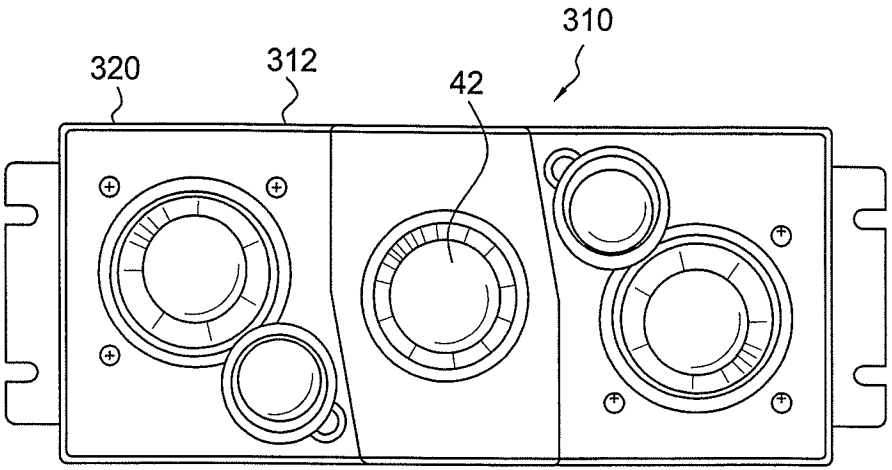
FIGS. 8 and 9 are respectively a top view and a side view of the speaker assembly shown with references to FIGS. 6 and 7.
Figure 9:
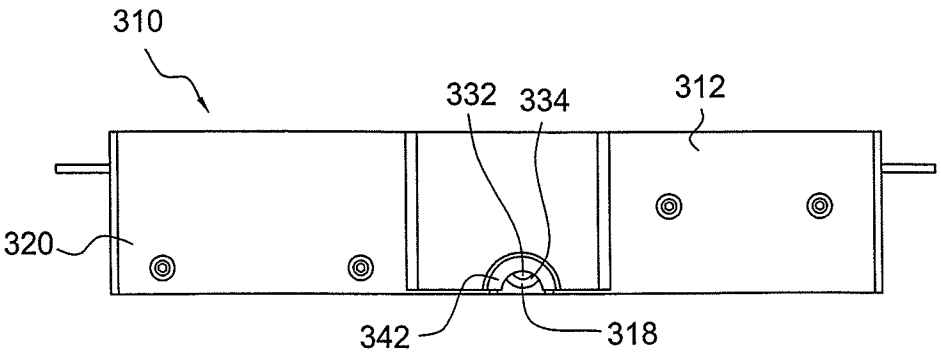

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIGS. 1 to 5, a small profile speaker assembly 10 shaped and dimensioned for use within an aircraft is disclosed. The speaker assembly 10 incorporates a variety of features which reduce the size and weight of the speaker assembly 10 without compromising the integrity of the sound generated by the speaker assembly 10. The speaker assembly 10 is primarily intended for use in aircraft, where weight and size are critical. While the speaker assembly 10 is preferably designed for use in aircraft, the speaker assembly 10 may be used in a variety of environments, such as, residential, automotive or computers, without departing from the spirit of the present invention.

The speaker assembly 10 includes a speaker housing 12 with a closed top wall 14, an opposed open end 16 and first, second, third and fourth sidewalls 18, 20, 22, 24 extending downwardly from the closed top wall 14. The closed top wall 14 is substantially planar and forms a support surface upon which the active speaker components are mounted. The speaker housing 12 is preferably constructed from aluminum, although other materials may be employed without departing from the spirit of the present invention.

In accordance with a preferred embodiment of the present invention, the closed top wall 14 is substantially rectangular, although other shapes may be employed without departing from the spirit of the invention. First and second wall mounts 26, 28 respectively extend from the first sidewall 18 and the third sidewall 22. The first and second wall mounts 26, 28 extend from the respective first sidewall 18 and third sidewall 22 such that they lie in a plane that is substantially parallel to the plane in which the closed top wall 14 lies. Each of the first and second wall mounts 26, 28 includes first and second apertures 30, 32 adapted for attaching the speaker assembly 10 within the fuselage of an aircraft.

The first and second wall mounts 26, 28 attach to a mounting bracket (not shown) of the aircraft. The wall mounts 26, 28 are adapted to facilitate the installation of the present speaker assembly 10 within an aircraft fuselage.

With reference to FIGS. 1 to 5, the active components of the speaker assembly 10 includes both directional and nondirectional speaker assemblies. The directional speaker assemblies are composed of first and second midrange drivers 34, 36 and first and second high frequency drivers (or tweeters 38, 40). The nondirectional speaker assembly is a public address driver 42. The active components are mounted within the speaker housing 12 such that the first midrange driver 34 and the first tweeter 38 are mirror images of the second midrange driver 36 and the second tweeter 40. While a speaker assembly with both stereo (as a result of the midrange drivers and tweeters) and paging (as a result of the public address driver) capabilities is disclosed in accordance with a preferred embodiment, it is contemplated these functionalities may be utilized together or alone without departing from the spirit of the present invention. By providing the present speaker assembly with both stereo and paging functionalities one is able to optimize both efficient use of space and weight. In particular, aircrafts require paging systems. As such, by incorporating the directional drivers with the public address driver, the present speaker assembly makes use of the existing aircraft structure to apply directional speakers for entertainment purposes.

In accordance with a preferred embodiment of the present invention, the first and second midrange drivers 34, 36, are constructed with carbon fiber cones 44 and neodymium magnets 46. With regard to the first and second tweeters 38, 40, they are provided with neodymium magnets 47 and polypropylene cones 49.

With the exception of the public address driver 42, the components are wired to produce stereo sound; that is, the first midrange driver 34 and first tweeter 38 are wired to receive a left channel signal, while the second midrange driver 36 and second tweeter 40 are wired to receive a right channel signal (not shown). The public address driver 42 is distinct from the other active components, and is designed for the transmission of announcement messages commonly issued from the flight crew. While this embodiment is disclosed as providing stereo sound, it is contemplated that the arrangement of components could be varied without departing from the spirit of the present invention.

The public address driver 42 is a conventional midrange driver with a cone 50 and is mounted substantially in the center of the speaker housing 12. The cone 50 includes an interior surface 52 which is directed toward the open end 16 of the speaker housing 12. The public address driver 42 is mounted upon a public address driver support bracket 54 shaped and dimensioned to fit within the speaker housing 12. More particularly, the public address driver support bracket 54 includes a planar support surface 56 from which first and second support legs 58, 60 extend. The first and second support legs 58, 60 engage, and are secured to and aligned with the interior surfaces of the second sidewall 20 and the fourth sidewall 24 of the speaker housing 12 for supporting the planar support surface 56 in a spaced relationship with regard to the closed top wall 14 such that the planar support surface 56 lies in a plane which is substantially parallel to the plane in which the closed top wall 14 lies. The public address driver support bracket 54 is shaped and dimensioned to fit laterally within the speaker housing 12 such that it extends from the second sidewall 20 to the fourth sidewall 24.

The planar support surface 56 includes central aperture 62 with a perimeter edge 64. The central aperture 62 is shaped and dimensioned to substantially match the profile of the upper edge 66 of the cone of the public address driver 42 such that the upper edge 66 of the cone 50 of the public address driver 42 is coupled to the underside wall 68 of the planar support surface 56 along the perimeter edge 64 thereof. The public address driver 42 is coupled to the planar support surface 56 using conventional techniques, for example, adhesive bonding, well known to those skilled in the art.

The public address driver support bracket 54 is also provided with internal walls 65, 67 extending between the second and fourth sidewalls 20, 24 and substantially parallel to the first and third sidewalls 18, 22. The internal walls are provided with apertures 469, 471 (see FIG. 10 as shown in accordance with an alternate embodiment) allowing for the passage of wires between the various drivers.

The planar support surface 56 is also substantially aligned with the upper edges 71 of the respective first, second, third and fourth sidewalls 18, 20, 22, 24. By aligning the planar support surface 56 in this way the present speaker assembly 10 is able to maximize the available space behind the public address driver 42, that is, the space defined by the backside of the planar support surface 56 and the housing 12, to provide optimal space for loading of the public address driver 42.

The first midrange driver 34 and first tweeter 38 are mounted along a first side of the closed top wall 14 adjacent the first sidewall 18 of the speaker housing 12. The first midrange driver 34 and first tweeter 38 are secured to the closed top wall 14 through the utilization of a first support bracket 72. The first support bracket 72 is composed of a planar support surface 74 from which first and second support legs 76, 78 extend. The first leg 76 engages, and is secured to, the second sidewall 20 adjacent the upper edge 71 of the second sidewall 20 and the second leg 78 engages, and is secured to the fourth sidewall 24 adjacent the juncture of the fourth sidewall 24 and the closed top wall 14 of the speaker housing 12 for supporting the planar support surface 74 in a spaced relationship with regard to the closed top wall 14 such that the planar support surface 74 lies in a plane which is obliquely oriented relative to the plane in which the closed top wall 14 lies. In accordance with a preferred embodiment, the planar support surface 74 is obliquely oriented to lie in a plane that is oriented at approximately an 18.5 degree angle with respect to the plane in which the closed top wall 14 lies. The first support bracket 72 is shaped and dimensioned to fit laterally within the speaker housing 12 such that it extends from the second sidewall 20 to the fourth sidewall 24, wherein the first leg 76 is positioned adjacent to the second sidewall 20 and the planar support surface 74 is obliquely angled such that the planar upper surface 86 thereof generally faces the fourth sidewall 24.

The planar support surface 74 includes central aperture 80 with a perimeter edge 82. The central aperture 80 is shaped and dimensioned to substantially match the profile of the upper edge 82 of the cone 44 of the first midrange driver 34 such that the upper edge 82 of the cone 44 of the first midrange driver 34 is coupled to the underside wall 84 of the planar support surface 74 along the perimeter edge 82 thereof. The first midrange driver 34 is coupled to the planar support surface 74 using conventional techniques, for example, adhesive bonding, well know to those skilled in the art.

As to the first tweeter 38, it is mounted to the planar upper surface 86 of the planar support surface 74 in a position between the central aperture 80 and the juncture of the shorter second leg 78 with the public address driver support bracket 54. In accordance with a preferred embodiment, the cone 49 of the first tweeter 38 extends no more than approximately 0.03 inches above the upper edges 71 of the respective first, second, third and fourth sidewalls 18, 20, 22, 24.

The second support bracket 90, which supports the second midrange driver 36 and the second tweeter 40, is substantially a mirror image of the first support bracket 72. As such, the second midrange driver 36 and second tweeter 40 are mounted along a second side of the closed top wall 14 adjacent the third sidewall 22 of the speaker housing 12. The second midrange driver 36 and second tweeter 40 are secured to the closed top wall 14 through the utilization of a second support bracket 90. The second support bracket 90 is composed of a planar support surface 92 from which first and second support legs 94, 96 extend. The first leg 94 engages, and is secured to, the fourth sidewall 24 adjacent the upper edge 71 of the fourth sidewall 24 and the second leg 96 engages, and is secured to the second sidewall 20 adjacent the juncture of the second sidewall 20 and the closed top wall 14 of the speaker housing 12 for supporting the planar support surface 92 in a spaced relationship with regard to the closed top wall 14 such that the planar support surface 92 lies in a plane which is obliquely oriented relative to the plane in which the closed top wall 14 lies. In accordance with a preferred embodiment, the planar support surface 92 is obliquely oriented to lie in a plane that is oriented at approximately an 18.5 degree angle with respect to the plane in which the closed top wall 14 lies. The second support bracket 90 is shaped and dimensioned to fit laterally within the speaker housing 12 such that it extends from the second sidewall 20 to the fourth sidewall 24, wherein the taller first support leg 94 is positioned adjacent to the fourth sidewall 24 and the planar support surface 92 is obliquely angled such that the upper surface 98 thereof generally faces the second sidewall 20.

The planar support surface 92 includes central aperture 100 with a perimeter edge 102. The central aperture 100 is shaped and dimensioned to substantially match the profile of the upper edge 104 of the cone 44 of the second midrange driver 36 such that the upper edge 104 of the cone 44 of the second midrange driver 36 is coupled to the underside wall 106 of the planar support surface 92 along the perimeter edge 102 thereof. The second midrange driver 36 is coupled to the planar support surface 92 using conventional techniques, for example, adhesive bonding or adhesive bonding with mechanical fasteners, well known to those skilled in the art.

As to the second tweeter 40, it is mounted to the upper surface 98 of the planar support surface 92 in a position between the central aperture 100 and the juncture of the second leg 96 with the public address driver support bracket 54. In accordance with a preferred embodiment, the cone 49 of the second tweeter 40 extends no more than approximately 0.03 inches above the upper edges 71 of the respective first, second, third and fourth sidewalls 18, 20, 22, 24.

The first tweeter 38 and the second tweeter 40 are respectively mounted on opposite sides of the speaker housing 12, that is, the first tweeter 38 is positioned adjacent the fourth sidewall 24 and is angled to substantially face the fourth sidewall 24 while the second tweeter 40 is positioned adjacent the second sidewall 20 and is angled to substantially face the second sidewall 20. Similarly, the first midrange driver 34 and the second midrange driver 36 are respectively mounted to face opposite sides of the speaker housing 12, that is, the first midrange driver 34 is angled to substantially face the fourth sidewall 24 while the second midrange driver 36 is angled to substantially face the second sidewall 20 enhancing the true stereo image produced by the present speaker assembly 10. The angular orientation of the first and second midrange drivers 34, 36 and the first and second tweeters 38, 40 produce a true stereo image with minimal "foot print" (that is, a true stereo image is produced with the use of minimal space)

Resilient, vibration absorbing spacers 110 are positioned between the public address driver support bracket 54, first support bracket 72, and second support bracket 90. The spacers 110 are chosen to be lightweight and to enhance the acoustics of the present speaker assembly 10. In accordance with a preferred embodiment of the present invention, the spacers are manufactured from fire-retardant, closed cell foam. In addition to separating the brackets, the spacers reduce noise and isolate the right and left sides from each other.

As stated above, the first tweeter 38 and first midrange driver 34 receive a left channel of a stereo signal and the second tweeter 40 and second midrange driver 36 receive a right channel of a stereo signal. By mounting the first tweeter 38 and the first midrange driver 34 such that they sit and transmit sound in the same plane and mounting the second tweeter 40 and the second midrange driver 36 such that they sit and transmit sound in the same plane, the present speaker assembly 10 provides for the transmission of a coherent sound image as the transmitted signal moves between the first and second tweeters 38, 40 and the respective first and second midrange drivers 34, 36. Although the first and second midranges/tweeters are closely mounted within a single speaker housing 12, a stereo image is produced by outwardly mounting the tweeters and midranges in opposition. Specifically, the tweeters 38, 40 and midrange drivers 34, 36 are obliquely mounted at approximately an 18.5° angle relative to the plane of the closed top wall 14. While a specific orientation for the tweeters and the midranges is disclosed in accordance with a preferred embodiment of the present invention, the tweeters and midranges may be oriented at other angles without departing from the spirit of the present invention.

As discussed above with regard to the public address driver 42, the first and second midrange drivers 34, 36 also require the creation of a minimal amount of space to properly load the drivers. That is, the enclosed space defined by the respective first support bracket 72 and the second support bracket 90 and the housing 12 must be sufficient to allow for optimal loading of the first and second midrange driver 34, 36 mounted to the respective first and second support brackets 72, 90. The angular orientation, however, has an effect upon the directional effectiveness of the first and second midrange drivers 34, 36 and the first and second tweeters 38, 40 in producing a stereo image. Considering the fact the space for loading is reduced as the angular orientation is increased, there is a tradeoff between the amount of space one may create and the stereo image generated. The preferred embodiment is believed to provide an optimal tradeoff, although it is contemplated other angular orientations may be employed without departing from the spirit of the present invention.

Installation of the speaker assembly 10 is completed by mounting the speaker assembly 10 at a desired location such that the opposed open end 16 of the speaker assembly 10 is directed toward the listening environment and the closed top wall 14 of the speaker housing 12 is directed away from the listening environment. The speaker assembly is positioned such that the open end 16 is placed in a facing relationship with an expanded metal/perforated speaker grill built into the structure of the aircraft. It should be appreciated that the first and second tweeters are oriented to minimize sound wave interference with the grill. Where the grill is not built into the structure of the aircraft, it is contemplated it may be secured to the speaker assembly via ball stud retainers or other selective coupling structures known to those skilled in the art.

With reference to FIGS. 6, 7, 8 and 9, an alternate embodiment is disclosed. The alternate embodiment is substantially the same as described above with regard to FIGS. 1-5. However, the closed top wall 314 of the speaker housing 312 is modified so as to improve the passage of wires therethrough and allow for positioning of the speaker assembly 210 in a lower profile orientation. As such, the various drivers and related structural elements not discussed below are the same as with reference to the embodiment of FIGS. 1-5 and the associated reference numerals are not set out herein.

In particular, the closed top wall 314 is provided with a first inwardly directed flange 316 and a second inwardly directed flange 318 formed along the surface thereof in the area of the public address driver 42. The first inwardly directed flange 316 and a second inwardly directed flange 318 extend toward the internal surface 322 defined by the speaker housing 312. The closed top wall 314 also includes first and second guide members 340, 342 respectively adjacent a first, inwardly directed flange 316 and a second inwardly directed flange 318. Each of the first guide member 340 and the second guide member 342 are semi-circular annular members extending upwardly from the closed top wall 314 at positions adjacent the edges of the closed top wall 314.

More particularly, the closed top wall 314 includes an external surface 320 and an internal surface 322. The internal surface 322 is that surface upon which the active components are mounted and the external surface 320 is that surface which is exposed to the external environment when the speaker assembly 310 is mounted in accordance with the present invention.

The first inwardly directed flange 316 and a second inwardly directed flange 318 are formed so as to extend within the central portion of the speaker housing 312 for allowing passage of wires therethrough and into engagement with the various drivers of the present loudspeaker assembly 310.

Each of the first inwardly directed flange 316 and the second inwardly directed flange 318 includes a first end 324 and a second end 326, as well as a first lateral side edge 328 and second lateral side edge 330. The first end 324 is secured to the closed top wall 314 while the second end 326 freely extends upwardly and into the space defined by the speaker housing 312. The first lateral side edge 328 and the second lateral side edge 330 also extend into the space defined by the speaker housing 312 and are not attached to any structure. An aperture 332 is formed adjacent the second end 326 of the respective first inwardly directed flange 316 and the second inwardly directed flange 318. The aperture 332 is shaped and dimensioned for passage of wires therethrough and is similarly provided with an internal grommet 334 defining a passageway for the wires. The grommet 334 is preferably made from a resilient plastic material forming a frictional engagement with the wires as they pass therethrough.

By forming the first inwardly directed flange 316 and a second inwardly directed flange 318 as described herein, wires may be readily passed to the internal cavity defined by the speaker housing 312 for attachment to the drivers.

Figure 10:
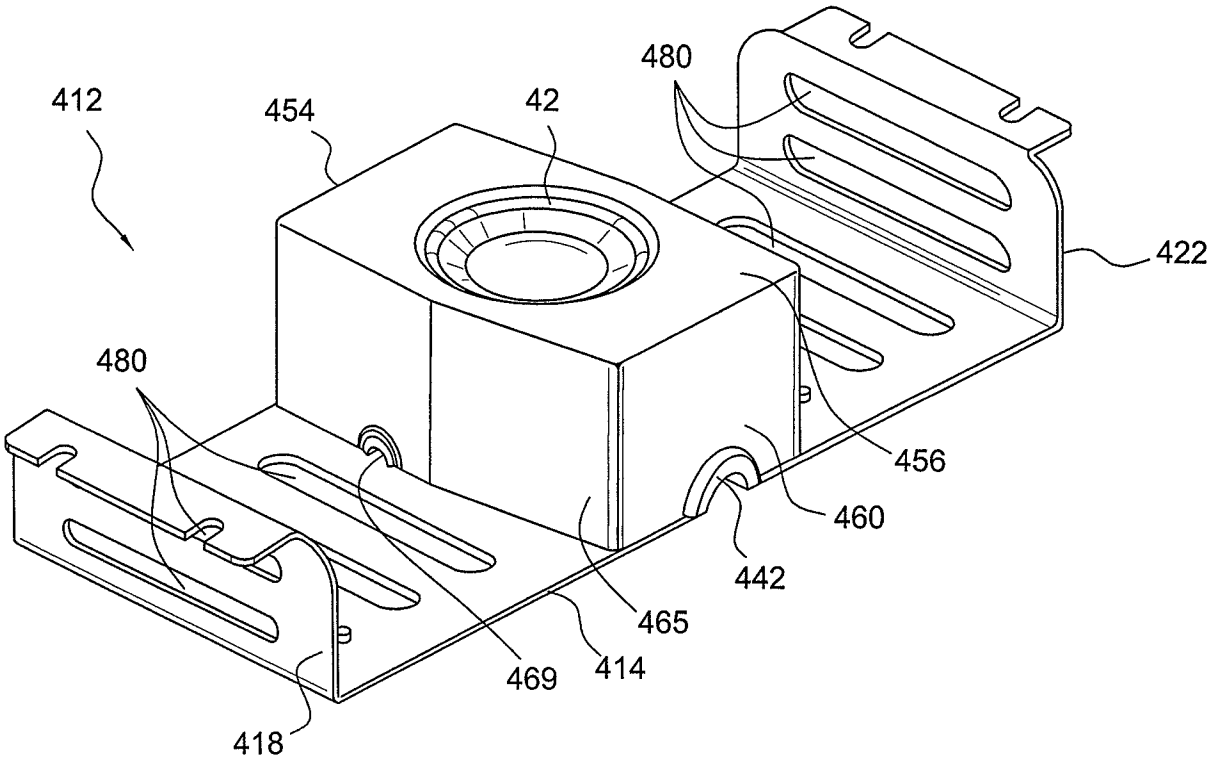
FIGS. 10, 11 and 12 show various views of an alternate embodiment of a speaker assembly employing only a public address driver.
Figure 11:
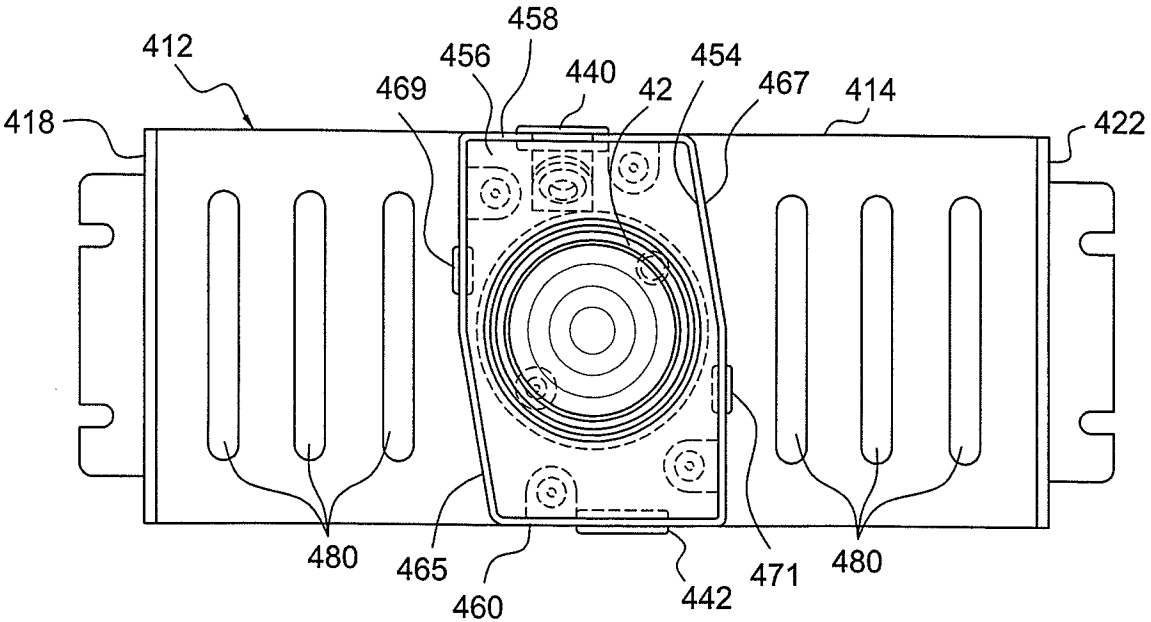
Figure 12:
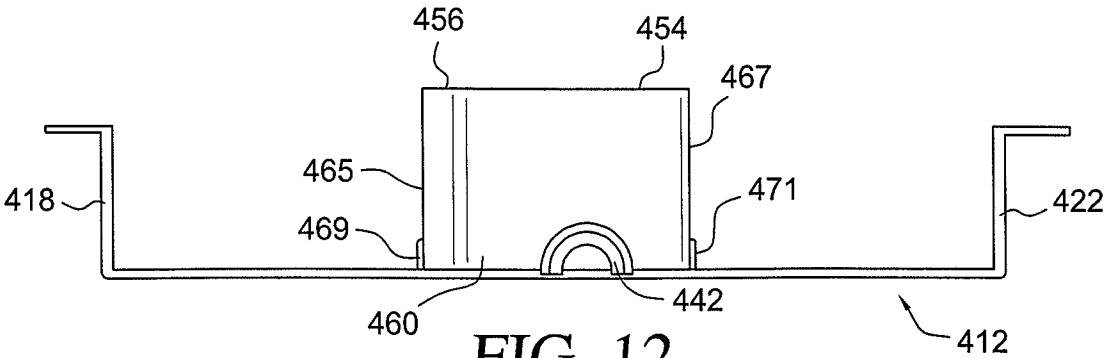

With reference to FIGS. 10, 11 and 12, an alternate embodiment is disclosed. In accordance with this alternate embodiment, only the public address driver 42 is employed. As such, much of the structure of the speaker housing 412 is unnecessary. With this in mind, the speaker housing 412 is only the public address driver 42 positioned along a central portion thereof.

The remainder of the speaker housing 412 is composed of the closed top wall 414 and the first and third sidewalls 418, 422. The closed top wall 414 and first and third sidewalls 418, 422 are all provided with cut out sections 480. These cut out sections 480 provide a structure which is lighter.

With regard to the public address housing, the public address driver 42 is mounted upon a public address driver support bracket 454 shaped and dimensioned to fit within the speaker housing 412 as discussed above. More particularly, the public address driver support bracket 454 includes a planar support surface 456 from which first and second support legs 458, 460 extend. The first and second support legs 458, 460 engage, and are secured along the first and second guide members 440, 442. As a result, the planar support surface 456 is supported in a spaced relationship with regard to the closed top wall 414 such that the planar support surface 456 lies in a plane which is substantially parallel to the plane in which the closed top wall 414 lies. The sidewalls 465, 467 of the public address driver support bracket 454 include lower apertures 469, 471 for the passage of wires which may be employed when the present device is utilized in accordance with preferred embodiments herein.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A speaker assembly, comprising:

a speaker housing includes a substantially planar closed top wall defining support surface, an opposed open end, a first sidewall extending downwardly from the closed top wall, and a third sidewall extending downwardly from the closed top wall, wherein each of the closed top wall, the first sidewall and the third sidewall includes cut out sections providing for a speaker housing with reduced weight;

the closed top wall includes a first guide member adjacent a second guide member at positions adjacent edges of the closed top wall; and a public address driver support bracket supporting a public address driver, the public address driver support bracket includes a planar support surface from which first and second support legs extend, the first and second support legs engage, and are secured along the first and second guide members.

2. The speaker assembly according to claim 1, wherein the first guide member and the second guide member are semi-circular annular members extending upwardly from the closed top wall.

3. The speaker assembly according to claim 1, wherein the planar support surface is supported in a spaced relationship with regard to the closed top wall such that the planar support surface lies in a plane which is substantially parallel to a plane in which the closed top wall lies.

4. The speaker assembly according to claim 1, wherein the public address driver bracket includes first and second sidewalls with lower apertures for passage of wires therethrough.

5. The speaker assembly according to claim 1, wherein the speaker housing consists essentially of the closed top wall, the first sidewall extending downwardly from the closed top wall, and the third sidewall extending downwardly from the closed top wall.

6. A speaker assembly, comprising:

a speaker housing with a closed top wall, an opposed open end and first, second, third and fourth sidewalls extending downwardly from the closed top wall, the closed top wall is substantially planar and forms a support surface;

first and second drivers mounted within the housing, wherein the first driver is a mirror image of the second driver;

a first support bracket supports the first driver and along a first side of the closed top wall adjacent the first sidewall of the speaker housing; the first support bracket includes a planar support surface which is obliquely oriented relative to a plane in which the closed top wall lies;

a second support bracket supports the second driver along a second side of the closed top wall adjacent the third sidewall of the speaker housing; the first support bracket includes a planar support surface which is obliquely oriented relative to the plane in which the closed top wall lies.

7. The speaker assembly according to claim 6, wherein first driver is a midrange driver and the second driver is a midrange driver.

8. The speaker assembly according to claim 6, wherein the first driver is a high frequency driver and the second driver is a high frequency driver.

9. The speaker assembly according to claim 6, further including a public address driver and a public address driver support bracket supporting the public address driver.

10. The speaker assembly according to claim 9, wherein the public address driver support bracket includes a planar support surface from which first and second support legs extend, the first and second support legs engage, and are secured to, an interior surface of the second sidewall and the fourth sidewall of the speaker housing for supporting the planar support surface in a spaced relationship with regard to the closed top wall such that the planar support surface lies in a plane which is substantially parallel to the plane in which the closed top wall lies.

11. The speaker assembly according to claim 10, wherein the planar support surface is also substantially aligned with upper edges of the respective first, second, third and fourth sidewalls.

12. The speaker assembly according to claim 6, wherein the first support bracket is composed of the planar support surface from which first and second support legs extend, the first leg engages, and is secured to, the second sidewall adjacent the upper edge of the second sidewall and the second leg engages, and is secured to the fourth sidewall adjacent the juncture of the fourth sidewall and the closed top wall.

13. The speaker assembly according to claim 12, wherein the planar support surface of the first support bracket is oriented to lie in a plane that is oriented at approximately an 18.5 degree angle with respect to a plane in which the closed top wall lies.

14. The speaker assembly according to claim 12, wherein the second support bracket is composed of the planar support surface from which first and second support legs extend, the first leg engages, and is secured to, the fourth sidewall adjacent the upper edge of the fourth sidewall and the second leg engages, and is secured to the second sidewall adjacent the juncture of the second sidewall and closed top wall.

15. The speaker assembly according to claim 14, wherein the planar support surface of the second support bracket is oriented to lie in a plane that is oriented at approximately an 18.5 degree angle with respect to a plane in which the closed top wall lies.

* * * * *